US005247908A

United States Patent [19]

Williamson

[11] Patent Number: 5,247,908

[45] Date of Patent: Sep. 28, 1993

[54] WALL CONTAINED HOT WATER HEATER

[76] Inventor: Thomas M. Williamson, 3004 Timberhill Dr., Jacksonville, Tex. 75766

[21] Appl. No.: 924,762

[22] Filed: Aug. 4, 1992

[51] Int. Cl.[5] ..... F24H 1/00

[52] U.S. Cl. ..... 122/13.2; 122/13.1; 392/451

[58] Field of Search ..... 122/13.1, 13.2, 19, 122/4 R; 392/441, 449, 451

[56] References Cited

U.S. PATENT DOCUMENTS 4,551,612 11/1985 Sprague ..... 122/13.2 X

*Primary Examiner*—Edward G. Favors

*Attorney, Agent, or Firm*—Leon Gilden

[57] ABSTRACT

A hot water heater is arranged and configured for mounting within a wall structure having a removable front panel, with the front panel having upper and lower openings for access to controls of the hot water heater tank assembly.

2 Claims, 3 Drawing Sheets

WALL CONTAINED HOT WATER HEATER

BACKGROUND OF THE INVENTION

1. Field of the Invention

The field of invention relates to hot water apparatus, and more particularly pertains to a new and improved wall contained hot water heater wherein the same is arranged for mounting within a wall construction.

2. Description of the Prior Art

Hot water heaters of various types are utilized throughout the prior art and typically are configured for mounting in various spaces as available. The instant invention in addressing a need for hot water reservoir structure for reception within a wall permits a more efficient use of available space within a dwelling. Prior art hot water heaters are exemplified in the U.S. Pat. Nos. 3,645,327; 4,791,888; 4,874,104; and 4,436,058.

The prior art has heretofore failed to provide for a compact, unitary organization as set forth by the instant invention to further include enhanced maintenance components to insure longevity of the hot water tank structure and in this respect, the present invention substantially fulfills this need.

SUMMARY OF THE INVENTION

In view of the foregoing disadvantages inherent in the known types of hot water heater structure now present in the prior art, the present invention provides a wall contained hot water heater wherein the same is arranged for mounting within a wall of a dwelling. As such, the general purpose of the present invention, which will be described subsequently in greater detail, is to provide a new and improved wall contained hot water heater which has all the advantages of the prior art hot water apparatus and none of the disadvantages.

To attain this, the present invention provides a hot water heater arranged and configured for mounting within a wall structure having a removable front panel, with the front panel having upper and lower openings for access to controls of the hot water heater tank assembly.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wall contained hot water heater which has all the advantages of the prior art hot water heater apparatus and none of the disadvantages.

It is another object of the present invention to provide a new and improved wall contained hot water heater which may be easily and efficiently manufactured and marketed.

It is a further object of the present invention to provide a new and improved wall contained hot water heater which is of a durable and reliable construction.

An even further object of the present invention is to provide a new and improved wall contained hot water heater which is susceptible of a low cost of manufacture with regard to both materials and labor, and which accordingly is then susceptible of low prices of sale to the consuming public, thereby making such wall contained hot water heaters economically available to the buying public.

Still yet another object of the present invention is to provide a new and improved wall contained hot water heater which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
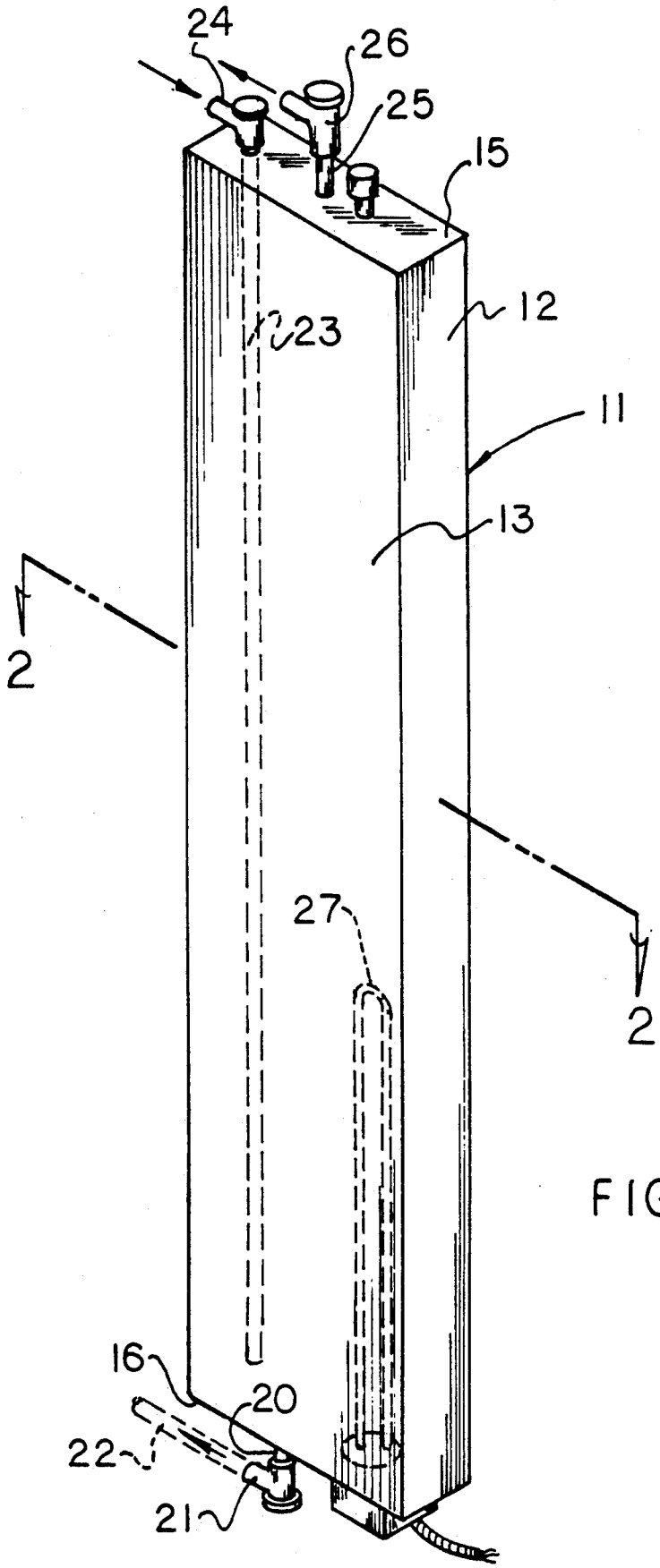
FIG. 1 is an isometric illustration of the instant invention.
Figure 2:
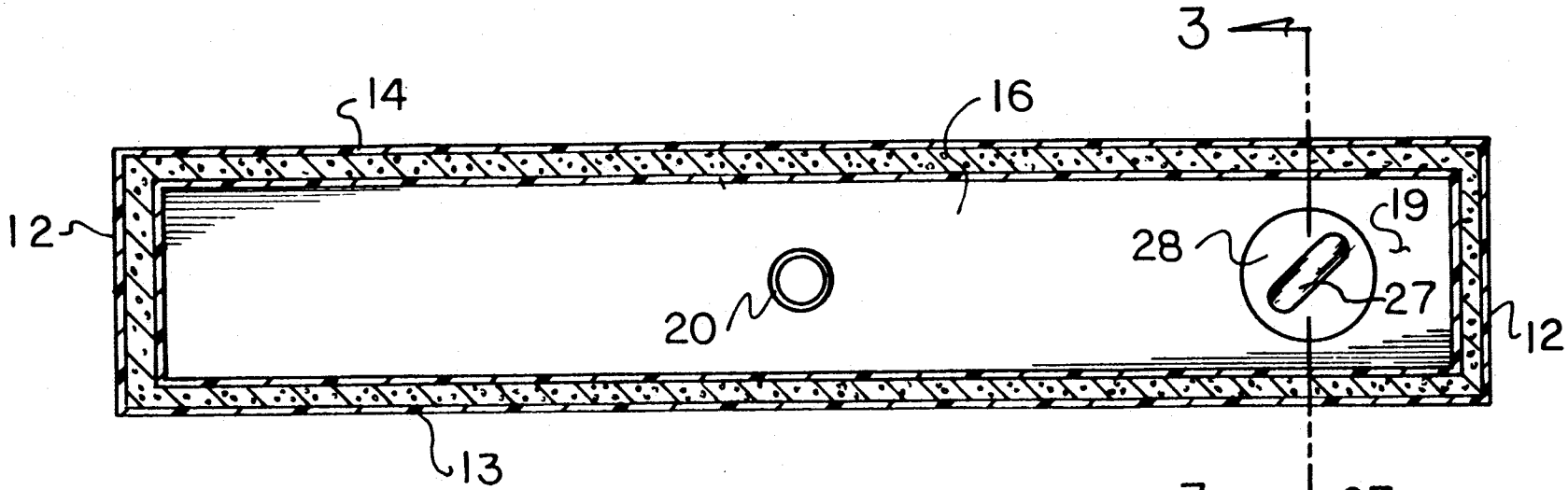
FIG. 2 is an orthographic view, taken along the lines 2—2 of FIG. 1 in the direction indicated by the arrows.
Figure 3:
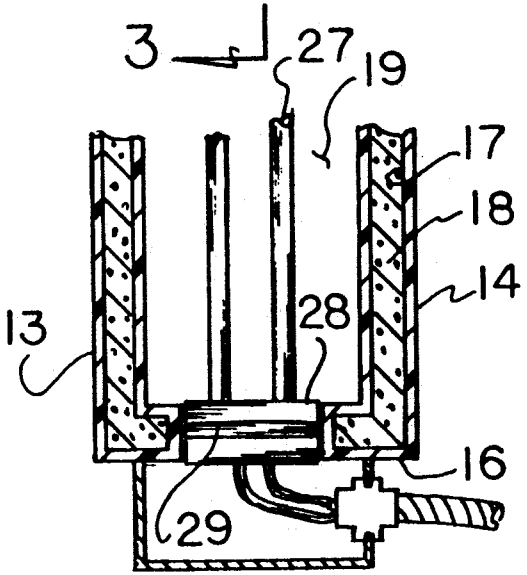
FIG. 3 is an orthographic view, taken along the lines 3—3 of FIG. 2 in the direction indicated by the arrows.

With reference now to the drawings, and in particular to FIGS. 1 to 4 thereof, a new and improved wall contained hot water heater embodying the principles and concepts of the present invention and generally designated by the reference numeral 10 will be described.

More specifically, the wall contained hot water heater of the instant invention is arranged for positioning within a wall of a dwelling, such as typified in FIG.

Figure 4:
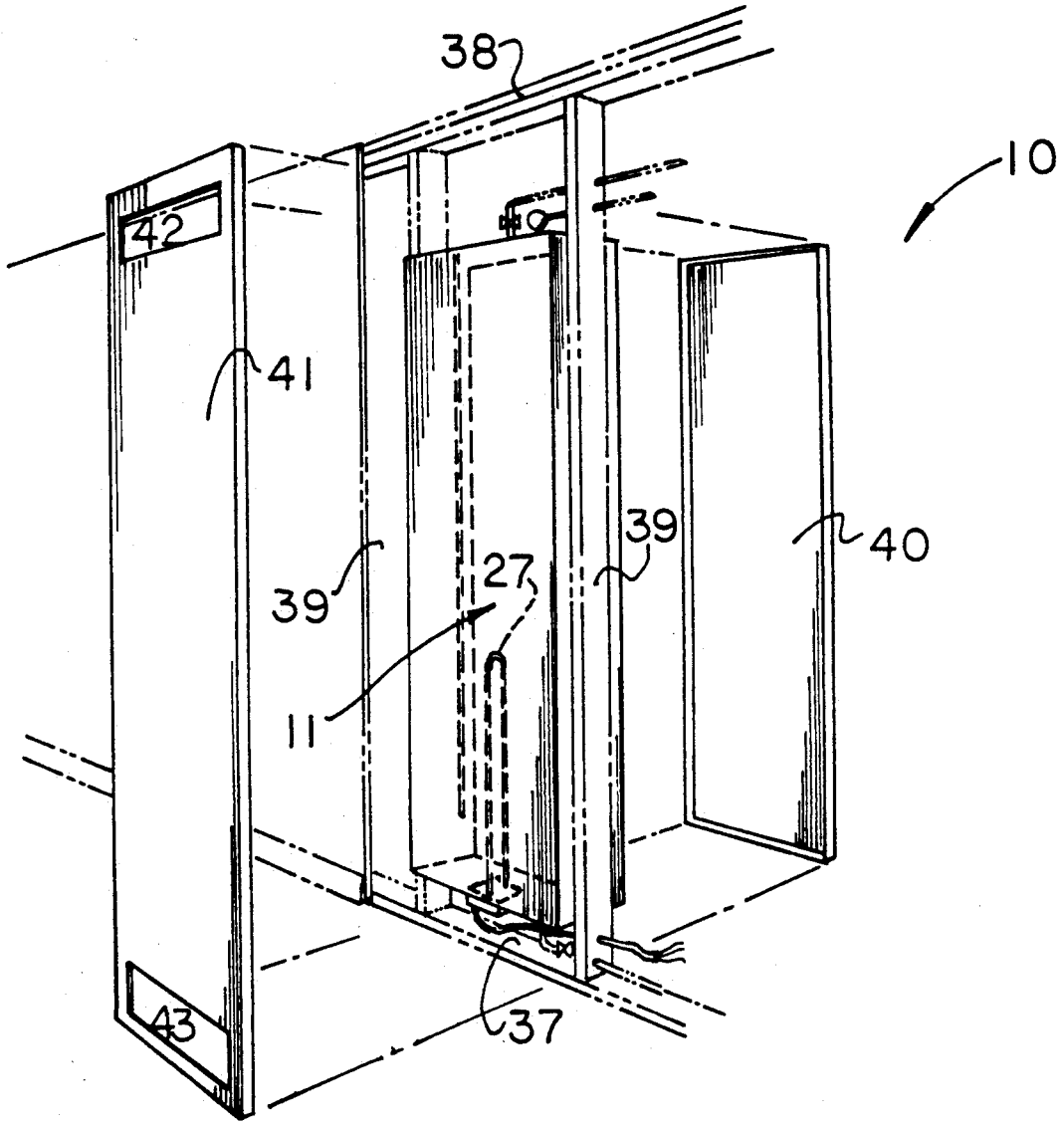
FIG. 4 is an isometric illustration of the invention in an associated wall and the various components for access to the hot water tank structure.

4. A tank member 11 is provided having tank member parallel side walls 12, a front wall 13, a rear wall 14, a top wall 15, and a bottom wall 16. The tank member 11 accordingly is of a parallelepiped configuration complementarily received between the sill plate 37, top plate 38, and the wall studs 39 of the wall assembly, as illustrated in FIG. 4. Accordingly, the side walls are spaced apart a predetermined spacing equal to the spacing between the stud members 39 and the wall assembly having a rear panel 40 positioned in adjacency relative to the rear wall 14 of the tank member 11, and a front panel 41 positioned in adjacency relative to the front wall 13 of the tank member. The front panel 41 is formed with an upper opening and a lower opening 42 and 43 respectively for access to the top and bottom walls 15 and 16 respectively, with the upper and lower openings 42 and 43 spaced apart a predetermined length substantially equal to the predetermined height of the front and rear walls 13 and 14. The wall construction of the tank member 11 is formed with a wall cavity 17 having an insulated material 18 coextensively directed therewithing formed typically of fiberglass, a polymeric insulative material and the like.

A heater fluid receiving cavity 19 is positioned within the tank member 11 for receiving the water to be heated. The water accordingly is drained by a first fluid drain conduit 20 directed through the bottom wall 16 through a conduit valve 21. The conduit valve 21 directs water therefrom to a second drain conduit 22 for disposal into the sewage fluid lines of an associated dwelling.

Inlet conduit 23 is directed into the tank member through the top wall 15 operative through an inlet conduit valve 24 for filling of the fluid receiving cavity 19. An outlet conduit 25 is operative through an outlet valve 26 to direct water therethrough into the plumbing of a dwelling structure, such as indicated in the FIG. 4.

A heating coil 27 is mounted within the fluid receiving cavity 19 positioned upon a coil support 28 having a sealing ring 29 to effect fluid sealing within the tank member 11 permitting ease of replacement thereof.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wall contained hot water heater arrangement in combination with a wall assembly, wherein the wall assembly includes a sill plate spaced from and positioned below a top plate, and spaced parallel wall studs fixedly mounted between the seal plate and the top plate, and a tank member positioned between the top plate and the sill plate, and the stud members defined by a predetermined thickness, and the tank member having spaced parallel side walls positioned between the stud members, and a front wall and a rear wall spaced apart a predetermined thickness, with the stud members equal to said predetermined thickness, and the tank member having a top wall and a bottom wall, with the top wall positioned in a spaced relationship relative to the top plate and the bottom wall positioned in a spaced relationship relative to the sill plate, and the tank member having a fluid cavity therewithin, and a drain conduit directed into the fluid cavity through the bottom wall, and a drain conduit valve in fluid communication with the drain conduit, and an inlet conduit directed into the fluid cavity through the top wall, with the inlet conduit including an inlet conduit valve in fluid communication with the inlet conduit, and an outlet conduit directed to the top wall spaced from the inlet conduit, and the outlet conduit having an outlet conduit valve, and a heating coil directed into the fluid cavity through the bottom wall.

2. A hot water heater as set forth in claim 1 further including a front panel mounted to the sill plate, the top plate, and the wall stud, with the front panel having an upper opening spaced from a lower opening, and the upper opening spaced from the lower opening a predetermined length, wherein the tank member top wall is spaced from the tank member bottom wall a predetermined height substantially equal to the predetermined length permitting access to the inlet conduit valve and outlet conduit valve through the upper opening and permitting access to the drain conduit valve through the lower opening.

* * * * *